United States Patent [19]

Pellow

[11] 4,365,467

[45] Dec. 28, 1982

[54] ROTATION RESISTANT WIRE ROPE

[75] Inventor: Donald L. Pellow, Lee's Summit, Mo.

[73] Assignee: Armco Inc., Middletown, Ohio

[21] Appl. No.: 215,612

[22] Filed: Dec. 12, 1980

[51] Int. Cl.[3] ..... D07B 1/00; D07B 5/00

[52] U.S. Cl. ..... 57/214; 57/212; 57/213; 57/218

[58] Field of Search ..... 57/200, 210, 211, 212, 57/214, 218, 213

[56] References Cited

U.S. PATENT DOCUMENTS

| | | | |
|---|---|---|---|
| 2,181,341 | 11/1939 | Reardon | 57/214 |
| 2,779,149 | 1/1957 | Schuller | 57/214 |
| 3,018,606 | 1/1962 | Dietz | 57/214 |
| 3,209,528 | 10/1965 | Zerr | 57/214 X |
| 3,306,022 | 2/1967 | Stevens | 57/214 |
| 3,391,530 | 7/1968 | Lex | 57/214 |

*Primary Examiner*—Donald Watkins
*Attorney, Agent, or Firm*—Frost & Jacobs

[57] ABSTRACT

A rotation resistant rope comprising a central multi-wire strand of Seale's construction, an intermediate layer comprising a plurality of multi-wire strands closed in one operation around the central strand, and a covering layer of 10 multi-wire strands closed around the intermediate layer. Each intermediate and covering layer of strands has a direction of lay opposite to that of the other layer of strands. The outside strands and core are always laid opposite each other, but the wires within each of these strands may be Lang lay, although Regular lay is preferred, particularly for the outside strands. The 10 outside strands may comprise from 7 to 26 wires and all of the strands are identical. However, in a preferred construction each of the outside strands consists of 19 wires. The intermediate layer and the central multi-wire strand may comprise a core of 25 elements, with the intermediately layer of the core comprising 8 to 10 strands, with all of the strands being identical, and the central multi-wire strand comprising a 1-8-8 wire strand, a 1-9-9 wire strand or a 1-10-10 wire strand.

14 Claims, 8 Drawing Figures

ROTATION RESISTANT WIRE ROPE

BACKGROUND OF THE INVENTION

This invention relates to torsion free or rotation resistant wire ropes made of spiral or helical strands such as used with hoists, derricks, cranes, and similar hoisting equipment. More specifically, the present invention relates to multi-layer ropes in which the layers have opposite directions of lay.

Ropes can be generalized into the groups of non-rotational and rotation resistant. Non-rotational resistant ropes tend to unravel or spin under load if both ends are not fixed. Therefore, those applications wherein one end is not fixed require a rotation resistant rope. Such applications might be where a tower crane lifts concrete buckets or building components from the ground to the top of multi-story buildings under construction. Another example is in oceanography wherein instruments are lowered from a ship to great depths into the ocean. In these situations, the longer the length of rope suspended, the more revolutions the support object on the unfixed rope end will turn if a non-rotational resistant rope is used. In still another example, in multiple reeving situations, a rotation resistant rope is necessary to prevent block spinning. For safety and/or technical reasons, rotation is undesirable.

Multi-layer ropes are known in the art which are substantially torsion free or rotation resistant. In practice, each strand is laid separately in such a manner that the inner layer or layers between the core and the outer or top layer are laid in a direction opposite to the outer layer. This gives the desired relative freedom from twist or rotation of the rope, such as when used to lift an unguided load.

Exemplary of the many patents dealing with rotation rope are U.S. Pat. No. 2,779,149, in the name of Heri Schuller, et al., and U.S. Pat. No. 3,729,921, in the name of Bernard Stroh.

Rotation resistant ropes are generally constructed using more outside strands and heavy cross-laid cores. Because of a generally larger contact angle between cross-laid outer strands and the core, these ropes have lower strength. On the other hand, non-rotational resistant ropes generally have fewer outside strands. These ropes have good crushing resistance and high breaking strengths. Accordingly, the prior art has long sought the development of a rotation resistant rope which will provide good crushing resistance and increased breaking strength comparable to that of non-rotational resistant ropes, while at the same time reducing the rope torque.

BRIEF SUMMARY OF THE INVENTION

The present invention provides a rotation resistant rope comprising a central multi-wire strand of Seale's construction, an intermediate layer comprising a plurality of multi-wire strands closed in one operation around the central strand, and a covering layer of 10 multi-wire strands closed around the intermediate layer, with each intermediate and covering layer of strands having a direction of lay opposite to that of the other layer of strands. The rope provides improved torque balancing characteristics to provide resistance to spinning of the rope under load, improved crushing resistance to drum winding or external factors and higher strength.

In a preferred embodiment, each strand of the covering layer comprises from 7 to 26 wires and all of the strands are identical. Each strand of the covering layer may be Regular lay or Lang lay, as desired.

The intermediate layer and the central multi-wire strand preferably comprise a core of 25 elements. In practice, the intermediate layer of the core may comprise 8, 9, or 10 strands, with all of the strands being identical, and the central multi-wire strand may comprise a 1-8-8 wire strand, a 1-9-9 wire strand, or a 1-10-10 wire strand, respectively.

The rotation resistant rope of the present invention provides improved torque balancing characteristics, resistance to spinning of the rope under load, improved crushing resistance to drum winding or external factors and higher strength.

DETAILED DESCRIPTION

Figure 1:
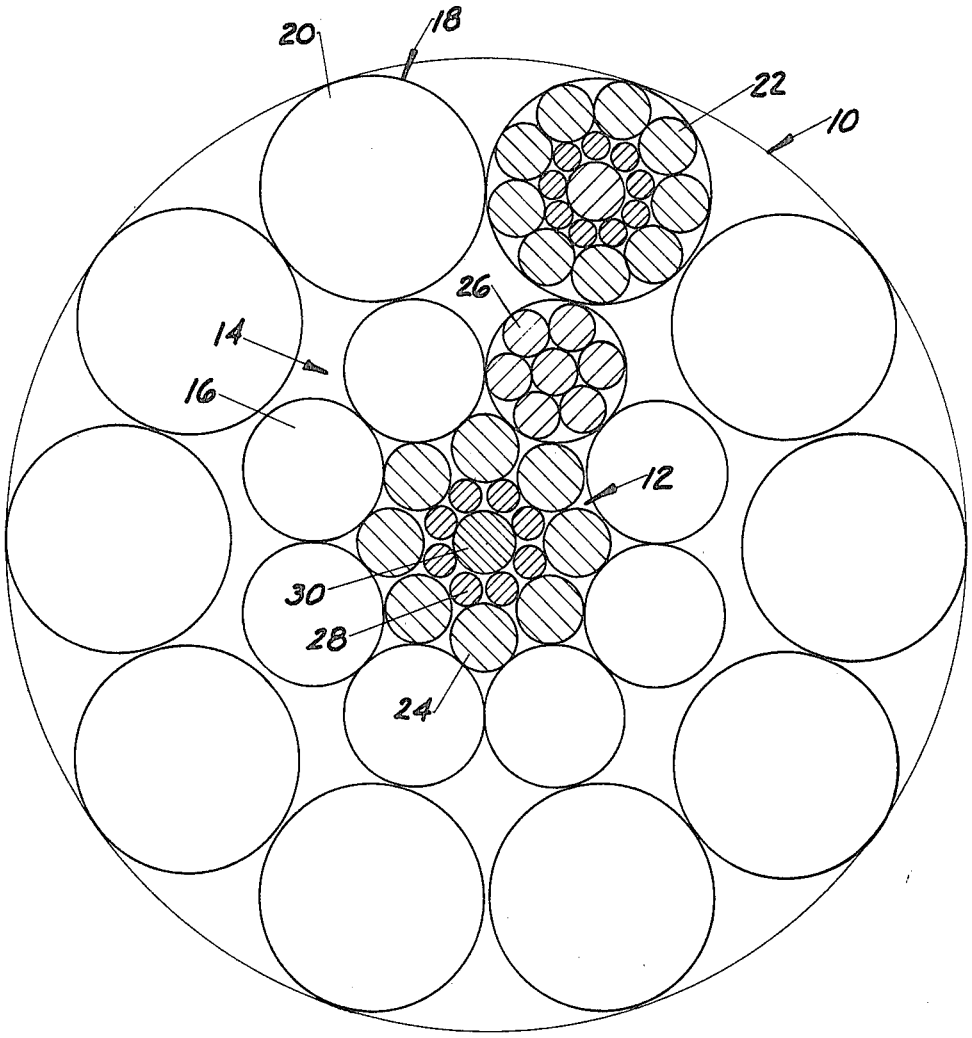
FIG. 1 is a diagrammatic cross sectional view through a wire rope according to the present invention.

Referring now more particularly to FIG. 1, it will be seen that the rotation resistant rope 10 of the present invention comprises a central multi-wire strand 12 of Seale's construction, an intermediate layer 14 comprising a plurality of multi-wire strands 16 closed in one operation around the central strand 12, and a covering layer 18 of 10 multi-wire strands 20 closed around the intermediate layer 14. Each intermediate layer 14 and covering layer 18 of strands 16 and 20, respectively, have a direction of lay opposite to that of the other layer of strands. For example, the covering layer 18 of strands 20 may be right hand lay and the intermediate layer 14 of strands 16 may be left hand lay. Conversely, the covering layer 18 of strands 20 may be left hand lay and the intermediate layer 14 of strands 16 may be right hand lay. Additionally, the covering layer of strands may be of Seale's construction.

Figure 2:
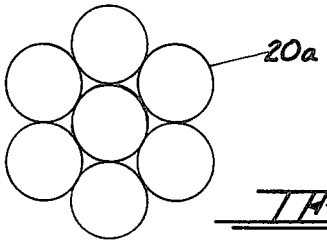
FIGS. 2 through 6 are diagrammatic cross sectional views through representative strands of the covering layer of strands of the wire rope according to the present invention.
Figure 3:
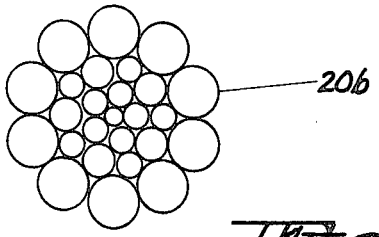
Figure 4:
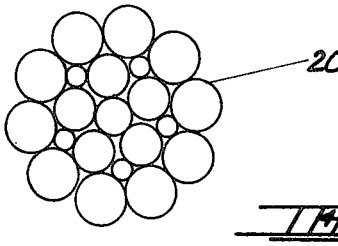
Figure 5:
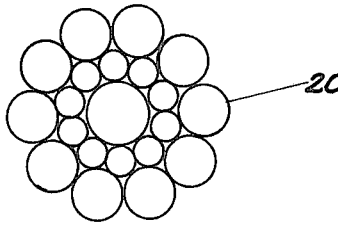
Figure 6:
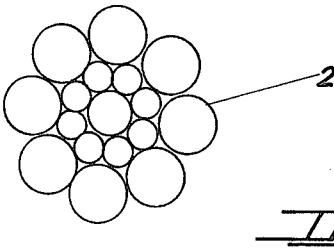

Each strand 20 of the covering layer 18 comprises from 7 to 26 wires 22, and all of the strands 20 are identical. It will be seen in FIG. 1 that in a preferred embodiment each strand 20 comprises 19 wires 22, while in FIGS. 2 and 3, each strand **20*a* and 20*b* comprises 7 and 26 (Warrington-Seale) wires, respectively. In FIGS. 4, 5 and 6, each strand 20*c*, 20*d* and 20*e*** comprises Filler Wire Type (21W) 1-5-5-10; 21W, Seale 1-10-10; and 17W, Seale 1-8-8, respectively.

Figure 7:
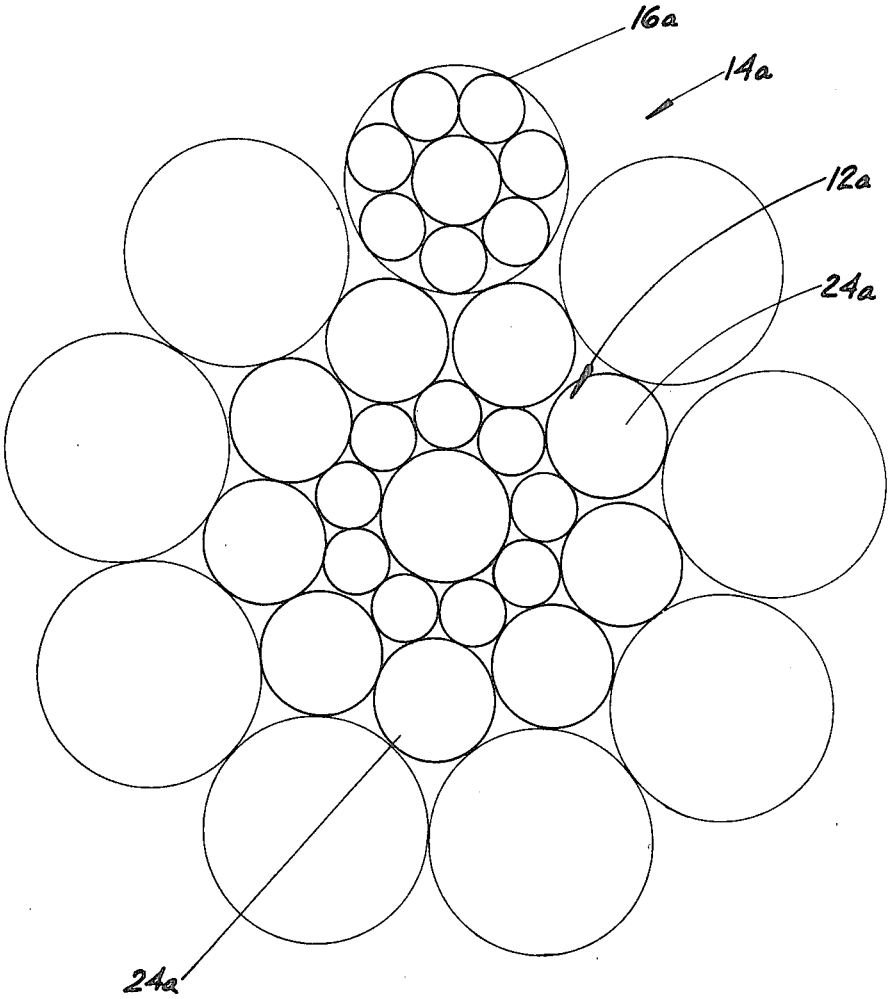
FIGS. 7 and 8 are diagrammatic cross sectional views through representative strands of the intermediate layer of strands and the central multi-wire strand of the wire rope of the present invention.
Figure 8:
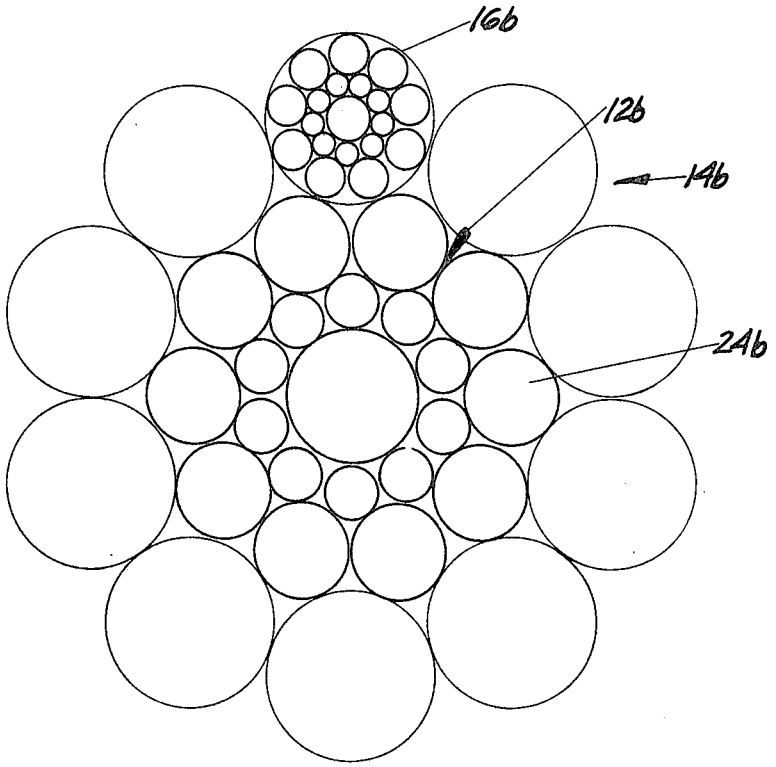

The intermediate layer 14 and central multi-wire strand 12 preferably comprise a core of 25 elements all laid together simultaneously in a Seale's construction. In a preferred embodiment, as shown in FIG. 1, the core comprises 8 outside strands 16 and 17 inner wires 24 of Seale's construction formed into a heart strand. In general, the intermediate layer 14 of strands 16 and the central multi-wire strand 12 of wires 24 comprise a core of 1-8-8 wire construction with 8 strands 16, each having 7 wires 26, as the outer layer. The strands 16 may be in a Regular lay or a Lang lay construction, as desired. In still further embodiments, as shown in FIGS. 7 and 8, the core may comprise 9 outside strands **16*a*** and 19 inner wires 24a of Seale's construction formed into a heart strand. In general, the intermediate layer 14a of strand 16a and the central multi-wire strand 12a of wires 24a comprise a core of 1-9-9 wire construction with 9 strands 16a as the outer layer. The strands 16a may be in a Regular lay or a Lang lay construction, as desired. Similarly, as shown in FIG. 8, the core may comprise 10 outside strands 16b and 21 inner wires 24b of Seale's construction formed into a heart strand. In general, the intermediate layer 14b of strands 16b and the central multi-wire strand 12b of wires 24b comprise a core of 1-10-10 wire construction with 10 strands 16b as the outer layer. Strand 16b may be in a Regular lay or a Lang lay construction, as desired.

In a preferred embodiment the central multi-wire strand 12, 12a or 12b and the intermediate layer 14, 14a or 14b are closed simultaneously in one step to form a core. In practice, the outside core strands 16, 16a or 16b, i.e., the intermediate layer 14, 14a or 14b, are made on a first stranding machine. Then, spools of these strands and spools of the core wires 24, 24a, 24b, are placed on a second stranding machine. The 8, 9 or 10 outside core strands 16, 16a or 16b, respectively, and the 17, 19 or 21 core wires 24, 24a, 24b respectively, are then simultaneously processed through a single closing die to form the completed core. In other words, the core strand, which comprises the central multiwire strand 12, 12a, 12b, is formed at the same time as the outside strands 16, 16a, 16b, of the intermediate layer 14, 14a, 14b are placed therearound. This is in contrast to the normal method wherein the core strand is made on a first machine, the outside core strands on a second machine, and all the strands are closed together on a third machine. Although the central strand 12 and intermediate layer 14 of the present invention may look like a rope, it is technically referred to as a single strand, since the wires 24, 24a, 24b of multi-wire strand 12, 12a, 12b are closed simultaneously with the strands 16, 16a, 16b, of the intermediate layer 14, 14a, 14b, respectively.

TABLE NUMBER 1

(1⅛" DIAMETER ROPE)

| | Rotation - Degrees Per Foot | | | | |
|---|---|---|---|---|---|
| Design Factor | 6 × 25 FW,FC (Non-Rotational Resistant) | 6 × 25 FW,IWRC (Non-rotational Resistant) | 19 × 7 (Rotation Resistant) | 8 × 25 CROSS-LAID (Rotation Resistant) | 10 × 19 SEALE (Rotation Resistant) |
| 6 | 130 | — | 3.6 | 16 | 7.3 |
| 5 | 137 | 193 | 4.4 | 22 | 8.8 |
| 4 | 162 | — | 5.4 | 30 | 10.5 |
| 3 | 204 | 316 | 6.7 | 44 | 13.0 |
| 2 | 274 | 450 | 10.0 | 130 | 17.4 |

FC = Fiber Core
FW = Filler Wire

Table Number 1 compares tests data of various rope designs to that of the rotation resistant wire rope 10 of the present invention. More specifically, Table 1 compares rotation of the 10×19 rotation resistant rope 10 as compared to two 6×25 non-rotational resistant ropes and the 19×7 and 8×25 rotation resistant ropes. The two non-rotational resistant ropes show very large amounts of rotation, which is to be expected. However, for the three remaining rotation resistant ropes, the 10×19 rotation resistant rope 10 of the present invention could best be compared to the 19×7 rope in rotation resistance, is superior to both the 8×25 and 19×7 in crushing resistance, and is superior in strength to both the 8×25 and 19×7 ropes. It will be seen that the amount of rotation of the 10×19 rotation resistant wire rope 10 of the present invention is greatly reduced over the 8×25 rope, particularly as the breaking load is approached (Design Factor 2).

TABLE NUMBER 2

All ropes compared are 1⅛" Extra Improved Plow Grade.

| Rope | Nominal Catalog Strength | 1980 Average Actual Breaking Strength |
|---|---|---|
| 19 × 7 (Rotation Resistant) | 106,200 lbs | 108,700 lbs |
| 8 × 25 (Rotation Resistant) | 114,609 lbs | (None ever produced) |
| 10 × 19 Seale (Rotation Resistant) | * | 134,800 lbs |
| 6 × 19 Class W, IWRC (Non-Rotational Resistant) | 130,000 lbs | 136,000 lbs |

*No nominal catalog strength exists; however, 6 × 19 Extra Improved Plow Grade strengths will be used, which in this 1⅛" size is 130,000 pounds.

Table Number 2 depicts breaking strength comparisons of these three rope designs. The tests show that the breaking strength of the 10×19 rotation resistant rope of the present invention will meet the nominal strengths of the 6×19 strength classification.

Table Number 2 shows the dramatic increase in tensile strength improvement of the rotation resistant rope 10 of the present invention. It will be seen that the 10×19 rope 10 had an actual breaking strength of about 15% and 25% more than the 19×7 and 8×25 ropes, respectively. As can been seen, it was found that the 10×19 rotation resistant rope 10 was at least as good, if not better than, a 6×19 non-rotational resistant rope.

The 10×19 Seale, rotation resistant rope 10 of the present invention provides improved rotation resistance over the conventional 8×25 Cross-Laid construction. While not having as much resistance to spinning as the common 19×7 design, it does provide superior crushing resistance to drum winding or external factors. The special 1-8-8-8 core provides a greater steel area to the rope than do the 8×25 and 19×7 ropes; thus, it improves crushing resistance and provides more strength to the overall rope. Hence the normal strength will be somewhat higher than the 8×25 and 19×7 constructions, meeting the 6×19 Class Nominal Strengths and will provide longer service life where drum crushing is a major consideration.

The rotation resistance of the rope 10 of the present invention is achieved by cross-laying the core and balancing the lays of the core and the outer strands 20 to achieve minimum torque with necessary rope flexibility. The 10 strand construction of the outer strands 20 is used to provide a good balance between torque of the outer strands 20 and torque of the core. While the 10 outer strands of compact construction (anywhere from 7 to 26 wires) may be used, the preferred design, as shown in FIG. 1, is a 19-wire Seale construction, since it is thought that this will provide the maximum crushing resistance available. This provides a balance of flexibility and rotation resistance. Additionally, the large core design provides more steel area and is all closed at the same time. The core construction, as explained herein, may comprise anywhere from 8 to 10 outer strands around a 1-8-8 wire strand, a 1-9-9 wire strand or a 1-10-10 wire strand, respectively.

Applicant wishes to emphasize that the actual improvements resulting from the new rope 10 of the present invention are a better balance between the core and outer strands for rotation resistance; more steel area in the core to provide higher strength; compact construction of the outer strands and core to resist crushing; and a good balance between wire strengths, sizes and rope construction to achieve higher strength in the 6×19 Extra Improved Plow grade classification.

It will be clear that various modifications may be made without departing from the spirit of the invention and there is no intention therefore to limit the claims otherwise than as specifically set forth.

What is claimed is:

1. A rotation resistant rope comprising a central multi-wire heart strand, of Seale's construction, having a central wire, an inner layer and an outer layer, an intermediate layer comprising a plurality of multi-wire strands closed in one operation around said central strand to form an independent wire rope core, the number of wires of both said inner and outer layers of said central multi-wire heart strand corresponding in number to the strands in said intermediate layer, and a covering layer of 10 multi-wire strands closed around said intermediate layer, each intermediate layer and covering layer of strands having a direction of lay opposite to that of the other layer of strands, whereby said rope provides improved torque balancing characteristics to provide resistance to spinning of the rope under load, improved crushing resistance to drum winding or external factors and high strength.

2. The rope according to claim 1, wherein said covering layer of strands is of Seale's construction.

3. The rope according to claim 1, wherein said covering layer of strands is of Regular lay and said intermediate layer of strands is of Lang lay.

4. The rope according to claim 2, wherein each strand of said covering layer comprises from 7 to 26 wires and all of said strands are identical.

5. The rope according to claim 4, wherein each strand of said covering layer comprises 19 wires.

6. The rope according to claim 1, wherein said intermediate layer and said central multi-wire strand comprise a core of 25 elements.

7. The rope according to claim 6, wherein said intermediate layer of said core comprises 8 strands, with all of said strands being identical, and said central multi-wire strand comprises a 1-8-8 wire strand.

8. The rope according to claim 6, wherein said intermediate layer of said core comprises 9 strands, with all of said strands being identical, and said central multi-wire strand comprises a 1-9-9 wire strand.

9. The rope according to claim 6, wherein said intermediate layer of said core comprises 10 strands and said central multi-wire strand comprises a 1-10-10 wire strand.

10. The rope according to claim 6, wherein said strands comprising said core are Lang lay.

11. The rope according to claim 7, wherein said strands comprising said core are Lang lay.

12. The rope according to claim 8, wherein said strands comprising said core are Lang lay.

13. The rope according to claim 9, wherein said strands comprising said core are Lang lay.

14. The rope according to claim 1, wherein said covering layer of strands are right hand lay and said intermediate layer of strands are left hand lay.

* * * * *